US011511403B2

(12) United States Patent
Gendre

(10) Patent No.: US 11,511,403 B2
(45) Date of Patent: Nov. 29, 2022

(54) JOINING TOOL FOR JOINING A DEFORMABLE ELEMENT TO A WORKPIECE

(71) Applicant: Dubuis et Cie. SAS, Villebarou (FR)

(72) Inventor: Guillaume Gendre, Villebarou (FR)

(73) Assignee: DUBUIS ET CIE S.A.S., Villebarou (FR)

( * ) Notice: Subject to any disclaimer, the term of this patent is extended or adjusted under 35 U.S.C. 154(b) by 0 days.

(21) Appl. No.: 17/643,077

(22) Filed: Dec. 7, 2021

(65) Prior Publication Data

US 2022/0176528 A1 Jun. 9, 2022

(30) Foreign Application Priority Data

Dec. 7, 2020 (EP) ..... 20315485

(51) Int. Cl.
*B21J 15/22* (2006.01)
*B21J 15/26* (2006.01)
(Continued)

(52) U.S. Cl.
CPC ..... *B25B 27/0014* (2013.01); *B21J 15/043* (2013.01); *B21J 15/046* (2013.01);
(Continued)

(58) Field of Classification Search
CPC ..... B25B 27/0014; Y10T 29/49943; Y10T 29/53739; B21J 15/043; B21J 15/046;
(Continued)

(56) References Cited

U.S. PATENT DOCUMENTS 3,008,598 A * 11/1961 Martin ..... B25B 27/0014 72/454
3,164,283 A * 1/1965 Olson ..... B21J 15/105 29/243.523
(Continued)

FOREIGN PATENT DOCUMENTS

CA 2012152 A1 * 9/1970 ..... B21J 15/105
EP 1803526 A1 * 7/2007 ..... B21D 39/20
(Continued)

OTHER PUBLICATIONS

EP Search Report dated May 21, 2021 cited in corresponding EP Patent Application No. 20315485.1.

*Primary Examiner* — Jermie E Cozart
(74) *Attorney, Agent, or Firm* — Michael P. Leary

(57) ABSTRACT

A power tool for joining a deformable element having a threaded shaft to a workpiece. The joining tool comprising a threaded dowel adapted to receive the threaded shaft and rotatably within the housing. A nose is arranged around the threaded dowel, and the dowel is slidably movable relative to the nose. A motor drives a drive train to rotate the threaded dowel. A hydraulic system drives another drive train to move the threaded shaft and compress the deformable element. The joining tool includes a sliding unit. The nose is attachable to the sliding unit, and in an attached position the nose is slidably connected to the housing so that the hydraulic system may move the nose axially to compress the deformable element.

15 Claims, 3 Drawing Sheets

(51) Int. Cl.

| | |
|---|---|
| ***B21J 15/06*** | (2006.01) |
| ***B21J 15/04*** | (2006.01) |
| ***B25B 27/00*** | (2006.01) |
| *B21J 15/28* | (2006.01) |

(52) U.S. Cl.
CPC ..... *B21J 15/06* (2013.01); *B21J 15/22* (2013.01); *B21J 15/26* (2013.01); *B21J 15/285* (2013.01); *Y10T 29/49943* (2015.01); *Y10T 29/53739* (2015.01)

(58) Field of Classification Search
CPC ... B21J 15/06; B21J 15/22; B21J 15/26; B21J 15/285
See application file for complete search history.

(56) References Cited

U.S. PATENT DOCUMENTS 4,070,889 A * 1/1978 DeCaro ..... B21J 15/105 72/114
2004/0118176 A1* 6/2004 Neri ..... B25B 23/0035 72/391.8
2004/0165945 A1* 8/2004 Shibata ..... B21J 15/045 29/524.1
2004/0216292 A1* 11/2004 Patton ..... B25B 27/0014 29/252
2004/0226159 A1* 11/2004 Harlow ..... B25B 27/0014 29/525.01
2007/0044292 A1* 3/2007 Stevenson ..... B21J 15/043 29/524.1
2007/0175010 A1* 8/2007 Wang ..... B21J 15/285 29/243.521

FOREIGN PATENT DOCUMENTS

EP 2093024 B1 9/2010
EP 2786843 B1 9/2019
EP 4008482 A1 * 6/2022 ..... B21J 15/22
FR 2015316 A1 * 4/1970 ..... B25B 27/0014
GB 1583818 A * 2/1981 ..... B21J 15/048

* cited by examiner

JOINING TOOL FOR JOINING A DEFORMABLE ELEMENT TO A WORKPIECE

CROSS-REFERENCE TO RELATED APPLICATION

This application claims priority from European Patent Application No. 20315485.1, filed on Dec. 7, 2020, the disclosure of which is incorporated herein by reference.

BACKGROUND OF THE INVENTION

The present invention relates to a joining tool for joining a blind element or deformable element, notably an earth bond or an insert to a workpiece. More particularly, the present invention relates to a joining tool like a battery powered riveting pistol using an electrical motor and a hydraulic system for setting deformable elements or blind elements like insert, earth bonds or blind rivet. The present invention is further directed to a method for joining a deformable element to a workpiece with such a joining tool.

The joining tool is notably a hand tool for installing blind elements or deformable elements. Such blind or deformable elements are fasteners with a foldable predetermined portion and a threaded shaft. For instance, they comprise a sleeve body and a bolt element (or shaft) led through the sleeve body. The blind element is typically first introduced into a hole of a workpiece. The sleeve body is then sectionally deformed by an axial movement of the bolt element relative to the sleeve body to fasten the deformable element to the workpiece. Such deformable element may also be known as blind rivet or pull mandrel rivet and is frequently used when a stable and permanent connection should be established with a workpiece which is only accessible from the outside, i.e. from one side, e.g. a closed hollow body. The joining tool is also adapted to be used with female inserts (for instance deformable nuts). In such cases, an additional threaded shaft is used and is screwed inside a threaded hole of the female insert. Therefore, in this context the term "deformable element with a threaded shaft" is to be understood either as an element with a foldable predetermined portion including a threaded shaft or an element such a female insert with a foldable predetermined portion having a threaded hole in which an additional threaded shaft is screwed or cooperating with an additional threaded shaft.

The joining tool according to the invention may notably be used to set earth bonds or inserts for fixing of an electric connector terminal to a wall or workpiece. Typically, an earth bond is used for fixing a cable connection to a mass. Different example of earth bonds or inserts are disclosed in European patent publications EP0575259A1, EP0880199 or EP 1 376 766 in the name of the applicant. Such earth bonds or inserts are deformable elements and are set into the hole of a workpiece as previously described, with a sleeve body being deformed by an axial movement of a shaft relative to the sleeve body to secure the deformable element to the workpiece.

Different tools already exist to set such deformable elements.

EP2786843 discloses a battery powered crimping tool for a rivet nut or an earth bond comprising a housing adapted to receive an electrical battery. The crimping tool comprises an electrical motor energizable by an electrical battery, a support for supporting rotation movement of a rod in relation to the housing, a first mechanical drive train drivable by the motor to cause rotation of a rod about a longitudinal axis in a screwing direction or an unscrewing direction, and a second drive train comprising a hydraulic pump fluidly coupled to a piston chamber containing a traction piston wherein the traction piston is movable from an initial position in the piston chamber by way of fluid pressure from the pump to cause axial displacement of a traction rod towards the housing. The pump of the second drive train is drivable by the motor to deliver fluid pressure to the piston chamber. The tool uses hydraulic power which may facilitate management of the tensile force directly proportional to the oil pressure in the tool and has only one motor to perform two different functions. The tool is proving satisfactory but is designed to be used with nuts and is not easily adaptable to deformable elements with a threaded shaft. Besides, the tool is not easily adjustable to the type of insert to be set and is notably not adjustable to deformable elements having different geometries or diameters.

WO0124956A1 depicted a riveting apparatus driven by a battery-powered electric motor. The apparatus comprises a head with an annular nose adapted to support the flange of a blind rivet, the stem of the blind rivet being griped by jaws which are movable in translation through a piston to perform a setting step. Such riveting apparatus are well known, but not adapted to be used with deformable elements as above-mentioned and not adaptable to different size of deformable elements.

BRIEF SUMMARY OF THE INVENTION

It is an object of the present invention to provide a joining tool for joining a deformable element, notably an earth bond or an insert to a workpiece, which overcomes these drawbacks, and in particular a tool which can be easily used with deformable elements of different sizes or of different geometries.

Accordingly, the present invention provides a joining tool for joining a deformable element to a workpiece according to claim 1. More particularly the joining tool for joining a deformable element to a workpiece comprises a housing adapted to receive an electrical battery and an electrical motor energizable by the electrical battery. The motor has a motor shaft connected to a rod. The joining tool further comprises a threaded dowel adapted to receive a threaded shaft (eventually a threaded shaft of a deformable element), the threaded dowel being rotatably movable around a longitudinal axis with regard to the housing, the threaded dowel being connected to the rod. A nose is arranged around the threaded dowel and the threaded dowel is slidably movable with regard to the nose. A first mechanical drive train drivable by the motor to cause rotation of the threaded dowel in a screwing direction or an unscrewing direction and a second drive train comprising a hydraulic system adapted for determining a plastic deformation of a predetermined portion of the deformable element are provided. The nose is removably attached to a sliding unit, and in the attached position, the nose is slidably connected to the housing such that the hydraulic system impresses an axial translation on the nose for determining a plastic deformation of a predetermined portion of the deformable element.

The presence of a removable nose piece allows to easily adapt the tool to different sizes of inserts or deformable elements. Besides, the nose is movable in translation through the hydraulic system. Pneumatically powered fastener installation tools normally utilize a hydraulic piston and cylinder arrangement to draw back the shaft of the deformable element. In the present case, the nose is movable, whereas the shaft of the deformable element is secured within the dowel and does not move with regard to the tool housing. This allows a better repartition of the setting forces applied and thus a reliable and stable setting process. Finally, the removable nose allows to easily remove a deformable element which could be stuck into the dowel.

In an embodiment, an elastic ring is arranged between the nose and the sliding unit in order to form a press fit connection between the nose and the sliding unit, such that the nose can be easily removed from the sliding unit. More particularly, the elastic ring is housed in a groove of the sliding unit. The press-fit connection allows an easy removing of the nose by a manipulator when needed. The elastic ring comprises for instance two parts connected to the sliding unit and adapted to be pressed against an outside surface of the nose to secure it to the sliding unit. Thus, a movement of the sliding unit is transferred to the nose when the nose is secured to said sliding unit.

In an embodiment, the threaded dowel is removably fixed to the rod. The threaded dowel, like the nose are removably attachable to the housing such that the tool can be adapted to the geometry or type of deformable insert to be set. In an embodiment, the threaded dowel is screwed to the rod.

In an embodiment, the rod comprises a first end connected to the threaded dowel and a second end connected to the motor shaft, and wherein in the vicinity of the second end a contact sensor is arranged, wherein the contact sensor is adapted to detect a pushing displacement applied to the threaded dowel, so that the presence of a threaded shaft at an entry of the threaded dowel is detected. The contact sensor activates directly the electrical motor to screw the deformable element into the dowel. Thus, the effort to perform the joining are reduced.

In an embodiment, the rod and the threaded dowel automatically rotate in a screwing direction when the sensor detects a pushing displacement applied to the threaded dowel, such that the threaded shaft is automatically screwed into the dowel.

In an embodiment, a ring is mounted on the rod, wherein the ring is connected to a finger, and the rotation of the motor is actuated in the screwing direction when a pushing displacement is applied to the ring and forwarded to the finger. No microswitch are necessary. For instance, the ring is secured against a rotation so that the finger remains aligned with the position sensor. When the threaded dowel is pushed by the deformable element, the displacement is forwarded to the ring and to the finger. Thus, a translation motion only is undertaken by the finger and the ring.

In an embodiment, a control card is provided and communicates with the sensor. The sensor enable the control card to exactly know the status of the tool in order to control and activate the different joining steps implemented by the tool. Beside, the control card may inform a user of the current status of the tool.

In an embodiment, the sliding unit is arranged around the electrical motor and is slidable with regard to the electrical motor. This allows a better repartition of the setting forces. In an embodiment, the sliding unit is slidable between a rest position and a setting position, the hydraulic system impressing an axial translation on said sliding unit to move it from the rest position to the setting position.

In an embodiment, a switch is provided to release the pression within the hydraulic system and to move the sliding unit from the setting position to the rest position. The pression release can be undertaken manually through this switch.

In an embodiment, a spring is arranged to force the sliding unit in the rest position when the hydraulic system does not impress axial translation. Notably when the pression is released, the spring forces the sliding unit in the rest position. In an embodiment, a calibration adjustment screw or permanent adjustment screw is provided, and wherein the calibration adjustment screw or permanent adjustment screw is adapted to set the necessary pressure in the hydraulic system for determining a plastic deformation of a predetermined portion of the deformable element.

The present invention is also directed to a method for joining a deformable element to a workpiece with a tool according to any of the preceding claims, comprising the steps of: providing a deformable element having a threaded shaft, selecting a threaded dowel corresponding to the deformable element to be set, screwing the threaded dowel to the rod, plugging the nose into the sliding unit, aligning the shaft of the blind element with the longitudinal axis of the threaded dowel, pushing the shaft of the deformable element against the dowel in order to automatically start the screwing of the deformable element into the threaded dowel, providing a workpiece with a hole and arranging the deformable element within a hole in the workpiece, pressing a trigger arranged on the housing of the tool to activate the hydraulic system in order to impress an axial translation on the sliding unit and on the nose for determining a plastic deformation of a predetermined portion of the deformable element, in order to set the deformable element within the hole of the workpiece, detecting the end of the setting step, unscrewing the threaded shaft of the deformable element.

It will be understood that the features of the invention mentioned above and those yet to be explained below can be used not only in the respective combination indicated, but also in other combinations or in isolation, without leaving the scope of the present invention.

BRIEF DESCRIPTION OF THE SEVERAL VIEWS OF THE DRAWINGS

The invention and its advantages will be better understood from the reading of the following description, given by way of example only and with reference to the accompanying drawings, of which.

DETAILED DESCRIPTION OF THE PREFERRED EMBODIMENTS

On the different figures, the same reference signs designate identical or similar elements.

Figure 1:
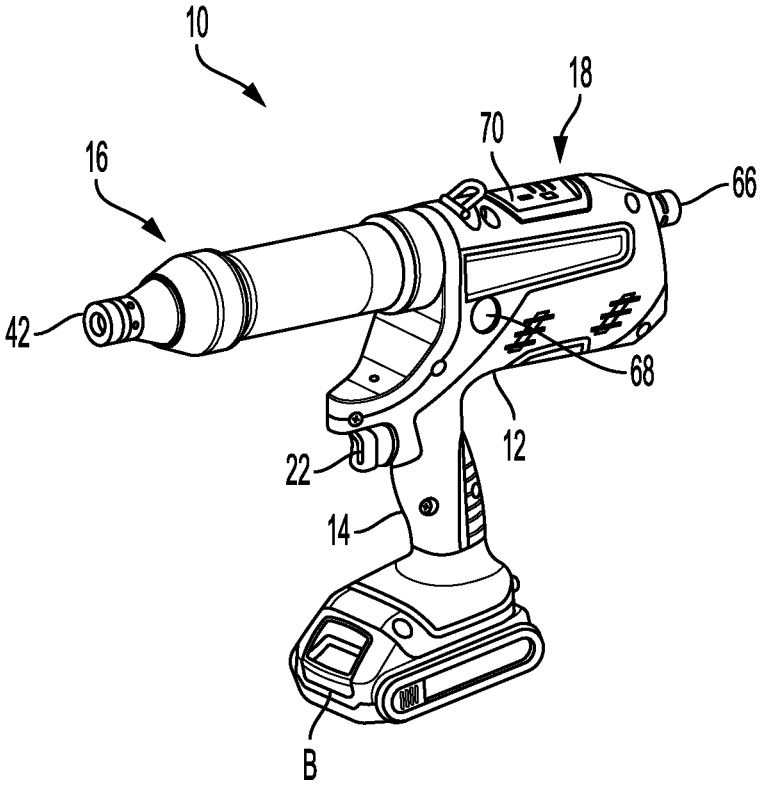
FIG. 1 is a perspective view of the joining tool according to the invention with a housing and an interchangeable nose.

The joining tool 10, as illustrated in FIG. 1, comprises a housing 12 with a handle 14. The housing 12 receives a rechargeable electrical battery B detacheably connected to the foot of the handle 14. The battery may be a 18V Li-ion battery or any similar battery. The tool 10 further comprises a fastening unit 16 adapted to receive a deformable element 20 and a transmission unit 18 arranged between the fastening unit 16 and the handle 14. The joining tool 10 further comprises a trigger system that includes a trigger 22 mounted on the housing 12 that allows a user to initiate a setting action for securing the deformable element 20 to a workpiece 24. The trigger 22 is for instance arranged on the handle 14. As depicted on FIG. 1, the fastening unit 16 and transmission unit 18 longitudinally extend in a direction sensibly orthogonal to the handle.

The deformable element (or blind element or blind fastener or deformable fastener) 20 is for example a blind rivet without breakaway pin member or an insert or an earth bond. The deformable element 20 comprises a shaft 26 and a sleeve 28 or bush having an enlarged flange 30. The flange and the sleeve may have a circular section and the diameter of the flange is greater than the diameter of the rest of the sleeve 28. The shaft 26 comprises a threaded portion.

Figure 2A:
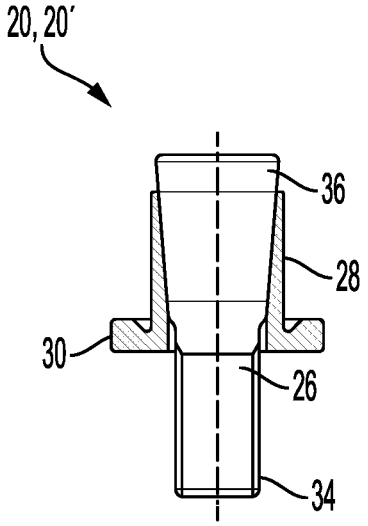
FIG. 2A shows a deformable element adapted to be used by the tool of FIG. 1, the deformable element being an insert comprising a shaft with an enlarged head and a sleeve with a flange, the sleeve being arranged around the head.

The joining tool 10 of FIG. 1 may notably be used with the earth bond 20' of FIG. 2A. However, as previously mentioned, other deformable element 20 may also be set with the joining tool 10. For instance, the deformable element can be a male insert or a female insert with an additional threaded shaft.

Figure 2B:
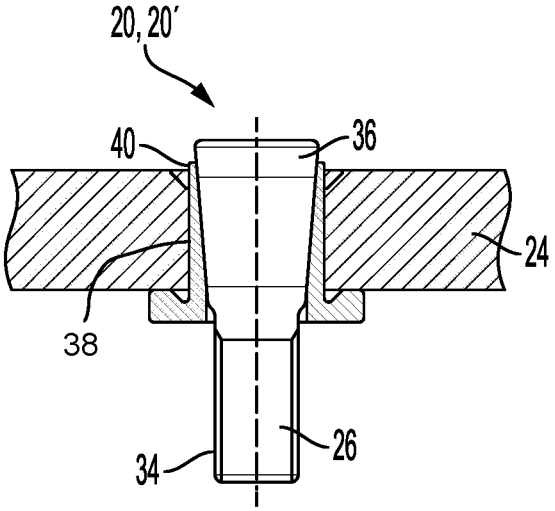
FIG. 2B shows the deformable element of FIG. 2A inserted in a workpiece after being set by the tool of FIG. 1.

The earth bond 20' of FIG. 2A comprises two pre-assembled components: a shaft 26 having a threaded portion 34 and a conical head 36, and a flanged sleeve 28, 30 or bush with an outside cylindrical diameter. The deformable element 20 is adapted to be inserted into a hole 38 of a workpiece 24. The joining tool 10 is designed to apply a tensile load which allows the shaft 26 to be pulled through the sleeve 28 or bush while remaining fixed in a pre-drilled hole 38 of a structure or workpiece 24. The shaft 26 being pulled deforms the sleeve 28, which secures the deformable element 20 to the workpiece 24. FIG. 2B illustrates the deformable element 20 secured to the workpiece 24.

The deformable element 20 is received in the fastening unit 16 of the joining tool 10. The fastening unit 16 comprises a threaded dowel 40 adapted to receive a threaded portion 34 of the shaft 26 of the deformable element 20. The threaded dowel 40 is for instance cylindrical and extends longitudinally along an axis X-X. The threaded dowel 40 is provided with a recess comprising an inner thread. The inner thread may be continuous or discontinuous. At least at both free end of the dowel 40, a threaded portion with an inner thread is provided. The dowel 40 is rotatably movable around a longitudinal axis with regard to the housing.

The fastening unit 16 further comprises a nose 42 arranged around the threaded dowel 40. The threaded dowel 40 is slidably movable with regard to the nose 42. The nose 42 is detacheably connected to the housing 12. The nose 42 forms a front end of the joining tool 10.

The fastening unit 16 is connected to the transmission unit 18 in order to perform the joining steps necessary to secure the deformable element 20 to the workpiece 24. The transmission unit 18 comprises an electrical motor 44 energizable by the electrical battery B. The electrical motor 44 is received within the housing 12 and is fixed with regard to the housing 12.

Figure 3:
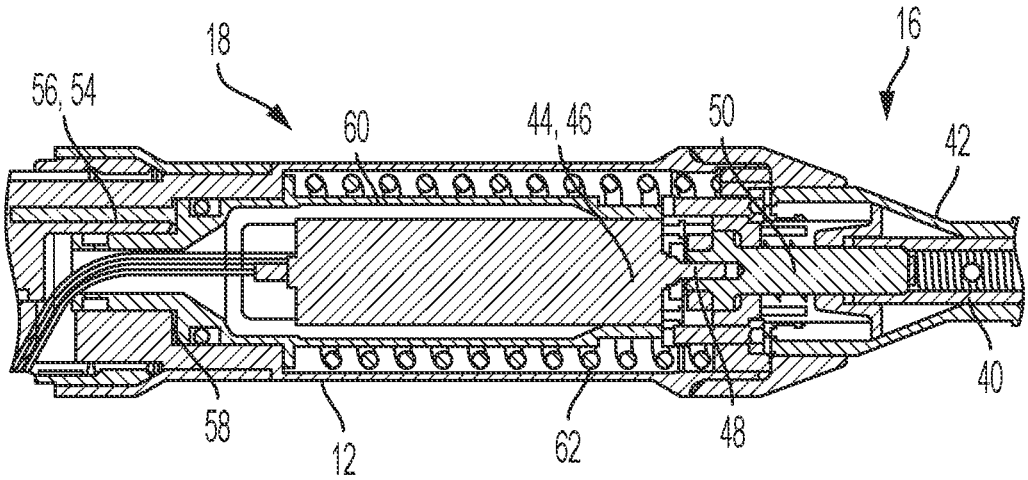
FIG. 3 shows a longitudinal cross-sectional partial view of the tool of FIG. 1 with the interchangeable nose and a threaded dowel adapted to receive a shaft of the deformable element.
Figure 4:
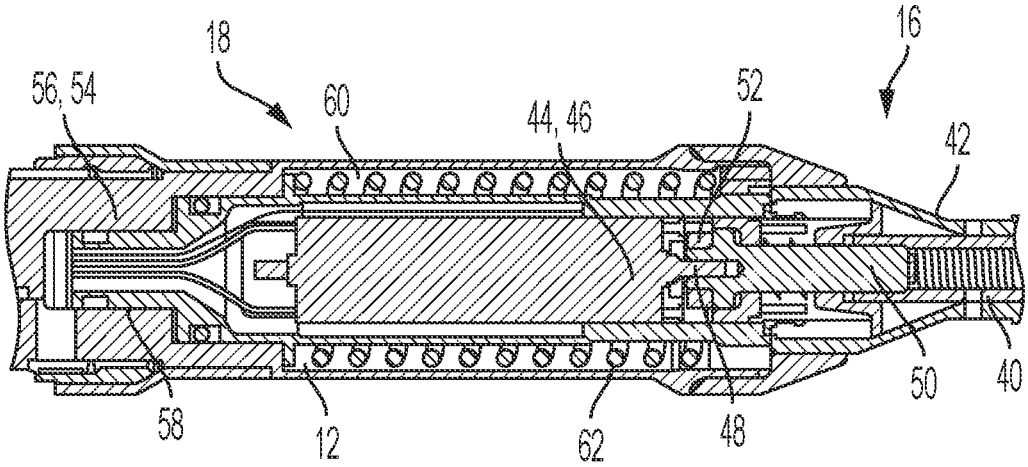
FIG. 4 shows another longitudinal cross-sectional partial view of the tool of FIG. 1 with a contact sensor.

The transmission unit 18 further comprises a first mechanical drive train 46 drivable by the motor 44 to cause rotation of the threaded dowel 40 in a screwing direction or an unscrewing direction. More particularly, the motor 44 comprises a motor shaft 48 connected to a rod 50, as depicted in FIG. 3 and FIG. 4. The threaded dowel 40 is connected to the rod 50. For instance, the threaded dowel 40 is detachably connected to the rod 50, such that a threaded dowel 40 adapted to the deformable element 20 to be set can conveniently be connected to the rod 50. Thus, the joining tool 10 is easily adaptable to several types of deformable elements 20. The threaded dowel 40 is notably screwed to the rod 50. However, in other embodiments, other connections may be implemented, as long as the rotatory motion of the rod is transferred to the threaded dowel. The threaded may be automatically screwed to the rod by a process similar to the one disclosed below in connection to the deformable element.

The rod 50 comprises a first end connected to the threaded dowel 40 and a second end connected to the motor shaft 48. For example, the rod 50 may comprises at its second end a hexagonal recess for keyed engagement with a hex bit of the motor shaft 48. The rod 50 may have a global cylindrical shape with a first segment having a first diameter at its second end, a third segment having a third diameter at its first end and a second segment extending between the first and third segment. The second segment has a second diameter, and the second diameter is larger than the first or third diameter. The second segment forms an enlarged flange. The third segment has a threaded portion for engagement with the threaded dowel 40.

A contact sensor 52 is arranged in the vicinity of the second end. More particularly, the contact sensor 52 is facing the first segment. The contact sensor 52 is adapted to detect the presence of a deformable element 20 at the dowel's entry. As disclosed in more detailed below the contact sensor 52 is integrated in a support adapted to remove the rotation movement. In other words, just a translational motion is detected and used.

More particularly, the dowel 40 comprises a first end and a second end. The first end is connected to the third segment of the rod 50, whereas the second end is adapted to receive the deformable element 20. When a deformable element 20 contacts the second end of the dowel 40, a force is applied to the dowel 40 which results in a small translation of the dowel 40 and the rod 50. The contact sensor 52 is adapted to detect this translation, thus detecting the presence of a deformable element 20 at the second end of the dowel 40.

Once the presence of a deformable element 20 has been detected at the second end of the dowel 40, the first mechanical drive train 46 is activated to cause rotation of the dowel 40 (through rotation of the motor shaft 48 and the rod 50). The rotation of the dowel 40 occurs in a screwing direction, in order to secure the deformable element 20 to the workpiece 24. In other words, the contact sensor 52 detects the presence of a deformable element 20 when the shaft 26 of the deformable element 20 is inserted into the dowel 40, thus determining an axial thrust on the dowel 40 which activates the electrical motor 44 in the screwing direction to secure the deformable element 20 to the dowel 40. The presence of a microswitch is not necessary to activate the electrical motor.

The contact sensor 52 comprises a finger arrangement. The contact finger arrangement is connected to the rod 50 and actuates the rotation of the motor shaft 48 in the screwing direction when a pushing displacement is applied to the threaded dowel. More particularly, a ring is mounted on the rod, wherein the ring is connected to a finger, and the rotation of the motor in the screwing direction is actuated when a pushing displacement is applied to the ring and forwarded to the finger. No microswitch are necessary. For instance, the ring is secured against a rotation so that the finger remains aligned with the position sensor. When the threaded dowel is pushed by the deformable element, the displacement is forwarded to the ring and to the finger. The finger actuates the motor or acts as a switch for the motor. The sensor 52 communicates with a control card. The control card can thus better determine and control the joining steps of the joining tool 10.

The deformable element 20 is released from the joining tool 10 when a rotation of the motor shaft in the unscrewing direction is activated.

The transmission unit 18 further includes a second drive train 54 comprising a hydraulic system 56 adapted for determining a plastic deformation of a predetermined portion of the deformable element. The hydraulic system 56 classically comprises a fluid which is provided to a chamber and contacting a piston surface 58 to apply a force on the piston surface 58.

A sliding unit 60 is arranged within the housing 12 and around the electrical motor 44. The sliding unit 60 is movable within the housing 12 and with regard to the motor 44. More particularly, the sliding unit 60 is movable in the fastening unit 16. The sliding unit 60 is partly hollow to receive the electrical motor. The hydraulic system 56 is connected to the sliding unit 60 and is adapted to impress an axial translation of the sliding unit 60. More particularly, the sliding unit 60 forms a hydraulic piston with a piston surface 58 to which the hydraulic fluid applies a pression for a translation of the sliding unit 60 within the housing 12 and around the electrical motor 44. The hydraulic system is activated when a user presses the trigger 22 for instance. The hydraulic system, in an embodiment, remains activated as long as an effort is applied on the trigger (as long as a user press the trigger 22).

Figure 5:
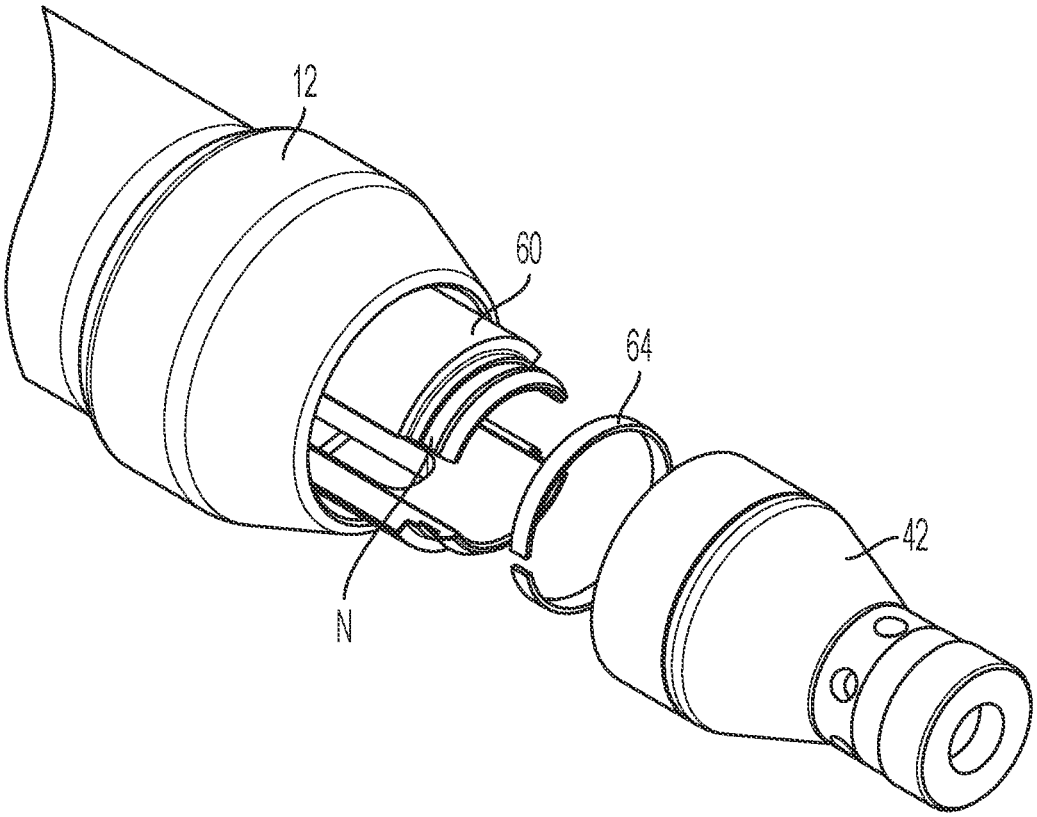
FIG. 5 shows an exploded view of the front end of the tool of FIG. 1 with an elastic ring.

As depicted in FIG. 3 and FIG. 4, the sliding unit 60 is sensibly cylindrical with a recess adapted to receive the motor 44, the motor shaft 48 and the rod 50. The sliding unit 60 is open at a first end, and the first end is connectable to the nose 42 through an elastic ring 64. The elastic ring is, as depicted in FIG. 5 a split ring. The split ring is arranged in a groove provided on the sliding unit 60.

At a second end, the sliding unit 60 is partially closed through the piston surface. A slot is provided at the second end of the sliding unit 60 for the passage of the motor wires and position sensor wires. The action of the hydraulic fluid forces the piston surface 58 and thus the sliding unit 60 to move forward. A spring or elastic element 62 is provided around the sliding unit 60 and between the housing 12 and the sliding unit 60 in order to maintain the sliding unit 60 in a rest position, when the hydraulic system 56 does not impress axial translation. The spring 62 guides the sliding unit 60. A first end of the spring 62 is contacting the housing 12, whereas a second end of the spring 62 abuts against an abutting surface of the sliding unit 60. The sliding unit 60 (and thus the nose) is movable from the rest position to a setting position when the hydraulic system impresses an axial translation on said sliding unit 60.

Besides, the nose 42 is connected to the sliding unit 60 such that the hydraulic system 56 impresses an axial translation on the nose 42 for determining a plastic deformation of a predetermined portion of the deformable element 20.

The housing 12 may be provided with a calibration adjustment screw (or permanent adjustment screw) 66. The calibration adjustment screw (or permanent adjustment screw) 66 may be actuated by a user to set a predetermined pressure of the hydraulic system 56 for a particular setting step with a particular deformable element. Thus, the pressure applied to the piston surface 58 (and thus to the sliding unit and the nose), which corresponds to the pression applied to deform the deformable element 20 can be adjusted to the deformable element used, or the application. Notably, the pression necessary to deform a M6 insert shall be different than the pression necessary for the deformation of a M10 insert. The calibration adjustment screw (or permanent adjustment screw) 66 allows notably to adapt the joining tool to the deformable element 20.

In order to perform the joining with the joining tool 10, the following steps can be implemented. A deformable element 20 is provided. The deformable element, as previously mentioned may be an earth bond or an insert. Depending on the deformable element provided or selected, a corresponding threaded dowel 40 is selected. The selected threaded dowel 40 is screwed to the threaded portion of the rod 50 and secured to the joining tool 10. A corresponding nose 42 may be selected and press-fitted to the sliding unit 60 of the joining tool 10. The selected nose may also be selected according to the kind of deformable element 20 used. A user may adjust the calibration adjustment screw or permanent adjustment screw 66 provided on the housing 12 in order to adjust the pressure delivered by the hydraulic system 56 to the selected deformable element 20. A colour code may be provided between the threaded dowel, the nose and/or the deformable element to help a user for an easy selection of the corresponding pressure. The joining tool 10 is then ready to be used for setting the deformable element 20 into a pre-drilled hole of a workpiece 24.

A user aligns the deformable element 20 with the longitudinal axis X-X of the threaded dowel 40 and applies a contact force between the second end of the threaded dowel 40 and the deformable element 20. The contact force is detected by the sensor 52 which activates the electrical motor 44. The rotation of the motor shaft 48 is transferred to the rod 50 which rotates the threaded dowel 40 in a screwing position in order to secure the deformable element 20 to the threaded dowel 40 by screwing the shaft 26 into the dowel 40. The deformable element 20 is screwed into the threaded dowel 40 until the flange 30 of the deformable element 20 abuts against the nose 42, and more particularly abuts against the front surface of the nose 42.

Once the deformable element 20 is secured to the joining tool, a user can insert the free end of the deformable element 20 into a pre-formed hole 38 of a workpiece 24. Eventually, the joining tool 10 may be provided with a light to enlighten the joining spot or the hole 38.

The flange 30 of the deformable element 20 comprises a first surface which abuts against the nose 42 and a second surface, opposite the first surface, which faces and contacts the workpiece 24, and more particularly which abuts against the surface delimiting the hole. The user then actuates the trigger 22.

The control card of the joining tool 10 can control and implement the different steps to plastically deform the deformable element 20 and to secure said deformable element 20 to the workpiece 24. For instance, once the trigger 22 has been actuated, the second drive train 54 is activated in order to impress an axial translation forward along a joining axis to the sliding unit 60 and the nose 42. In an embodiment, for the automatic screwing of the deformable element, the control card can be activated by a short press on the trigger 22.

The nose 42 applies an axial effort against the flange 30 which results in the threaded dowel 40 moving the shaft backwards with regard to the flange and the sleeve. The axial movement of the shaft 26 relative to the sleeve sectionally deforms the sleeve 28 causing the sleeve 28 to expand against the workpiece 24 thereby fastening said deformable element 20 in place. Once the sleeve 28 has been deformed, the control card may order the first drive train 46 to move the threaded dowel 40 in the unscrewing direction in order to release the threaded shaft 26 from the dowel 40 and thus the deformable element 20 is released from the joining tool 10.

In order to reset the pressure within the second drive train 54, a switch or release button 68 may be provided on the housing 12. The release button 68 may be manually operated by the user. However, in a particular embodiment, an automatic resetting of the pressure may be operated. The release button 68 allows to reset the pressure within the hydraulic system 56, thus releasing the hydraulic forces applied to the piston surface 48. The sliding unit 60 may then move back to its rest position, notably with the spring guiding it up to its rest position.

The joining tool 10 is then ready for the next joining action. The present tool is easy to use, with only one trigger for operating the entire joining process. Eventually a display 70 may be provided in order to show the actual status of the joining tool, for instance for indicating that the hydraulic forces have not been reset, or that the joining tool is ready for a new joining. The detachable nose allows to remove any deformable element stuck into the dowel without damaging the joining tool 10. Indeed, the nose and the dowel may both be unscrewed in order to release a jammed deformable element 20. In an embodiment, and for security reasons, the nose 42 and the threaded dowel 40 can be detached from the rest of the tool and/or replaced with another nose or another threaded dowel only after removing the battery B.

Although exemplary embodiments of the present invention have been shown and described, it will be appreciated by those skilled in the art that changes may be made to these embodiments without departing from the principles and spirit of the invention, the scope of which is defined in the appended claims and their equivalents.

joining tool 10
housing 12
handle 14
fastening unit 16
transmission unit 18
deformable element 20
trigger 22
workpiece 24
shaft 26
sleeve 28
flange 30
threaded portion 34
conical head 36
hole 38
threaded dowel 40
nose 42
electrical motor 44
battery B
first mechanical drive train 46
motor shaft 48
rod 50
contact sensor 52
second drive train 54
hydraulic system 56
piston surface 58
sliding unit 60
spring or elastic element 62
elastic ring 64
calibration adjustment screw or permanent adjustment screw 66
release button 68
display 70

What is claimed is:

1. A joining tool for joining to a workpiece a deformable element having a threaded shaft and a predetermined portion for deformation, the joining tool comprising:

a housing;

an electrical motor including a motor shaft connected to a rod;

a threaded dowel adapted to receive the threaded shaft of the deformable element, the threaded dowel rotatable relative to the housing around a longitudinal axis, and the threaded dowel is connected to the rod;

a nose arranged around the threaded dowel, and the threaded dowel is slidably movable relative to the nose;

a first drive train drivable by the motor to cause rotation of the threaded dowel in a screwing direction or an unscrewing direction;

a second drive train comprising a hydraulic system and operable for deforming the deformable element; and a sliding unit, and the nose is removably attachable to the sliding unit, and, in an attached position, the nose is slidably connected to the housing, and the hydraulic system is operable to impress an axial translation on the nose for deforming the deformable element.

2. The joining tool according to claim 1, and further comprising an elastic ring arranged between the nose and the sliding unit in order to form a press fit connection between the nose and the sliding unit, such that the nose can be easily detached.

3. The joining tool according to claim 1, wherein the threaded dowel is removably fixed to the rod.

4. The joining tool according to claim 3, wherein the threaded dowel is screwed to the rod.

5. The joining tool according to claim 1, wherein the rod comprises a first end connected to the threaded dowel and a second end connected to the motor shaft, and a contact sensor is arranged in the vicinity of the second end, and the contact sensor is operable to detect a pushing displacement applied to the threaded dowel, so that the presence of the deformable element at an entry of the threaded dowel is detected.

6. The joining tool according to claim 5, wherein the rod and the threaded dowel automatically rotate in a screwing direction when the contact sensor detects a pushing displacement applied to the threaded dowel, such that the threaded shaft is automatically screwed into the threaded dowel.

7. The joining tool according to claim 5, and further comprising a ring mounted on the rod, and the ring is connected to a finger, and rotation of the motor shaft in the screwing direction is actuated when a pushing displacement is applied to the ring and transmitted by the ring to the finger.

8. The joining tool according to claim 5, and further comprising a control card that communicates with the contact sensor.

9. The joining tool according claim 1, wherein the sliding unit is arranged around the electrical motor and is slidable relative to the electrical motor.

10. The joining tool according to claim 1, wherein the sliding unit is slidable between a rest position and a setting position, and the hydraulic system impresses an axial translation on the sliding unit to move it from the rest position to the setting position.

11. The joining tool according to claim 10, and further comprising a switch operable to release the pressure within the hydraulic system and to move the sliding unit from the setting position to the rest position.

12. The joining tool according to claim 10, and further comprising a spring arranged to force the sliding unit into the rest position when the hydraulic system does not impress the axial translation.

13. The joining tool according to claim 1, and further comprising a calibration adjustment screw operable to set a necessary pressure in the hydraulic system for deforming the deformable element.

14. A method for joining a deformable element to a workpiece with a joining tool, the method comprising the steps of:

providing the deformable element including a threaded shaft and a predetermined portion for deformation;

providing the joining tool comprising:

a housing;

an electrical motor including a motor shaft connected to a rod;

a threaded dowel adapted to receive the threaded shaft and rotatably relative to the housing around a longitudinal axis, and the threaded dowel is connected to the rod;

a nose arranged around the threaded dowel, and the threaded dowel is slidably movable relative to the nose;

a first mechanical drive train drivable by the motor to cause rotation of the threaded dowel in a screwing direction or an unscrewing direction;

a second drive train operable by a hydraulic system for deforming the deformable element;

a sliding unit, and the nose is removably attachable to the sliding unit, and, in an attached position, the nose is slidably connected to the housing such that the hydraulic system may impress an axial translation on the nose for deforming the deformable element; and selecting a threaded dowel and a nose compatible with the deformable element to be set;

screwing the threaded dowel to the rod;

plugging the nose into the sliding unit;

aligning the threaded shaft of the deformable element with the longitudinal axis of the threaded dowel;

pushing the threaded shaft of the deformable element against the threaded dowel in order to automatically start the screwing of the deformable element into the threaded dowel;

providing the workpiece with a hole and arranging the deformable element within the hole in the workpiece;

setting the deformable element within the hole in the workpiece by pressing a trigger arranged on the housing of the tool to activate the hydraulic system to impress an axial translation on the sliding unit and on the nose for deforming the deformable element, and;

detecting the end of the setting step; and unscrewing the threaded shaft of the deformable element.

15. The method according to claim 14, and further comprising the step of resetting the pressure within the hydraulic system.

* * * * *